US006086741A

United States Patent [19]

Sakashita et al.

[11] Patent Number: 6,086,741

[45] Date of Patent: Jul. 11, 2000

[54] PROCESS FOR SULFURIZING TREATMENT OF FERROUS ARTICLES

[75] Inventors: Takeo Sakashita, Shizuoka-ken; Motoyoshi Yamauchi, Hamamatsu, both of Japan

[73] Assignee: Dowa Mining Co., Ltd., Tokyo, Japan

[21] Appl. No.: 09/006,434

[22] Filed: Jan. 13, 1998

[30] Foreign Application Priority Data

Jan. 13, 1997 [JP] Japan ..... 9-014804

[51] Int. Cl.[7] ..... C25D 3/66; C25D 5/34; C25D 17/12

[52] U.S. Cl. ..... 205/97; 205/96; 205/211; 205/230; 205/231

[58] Field of Search ..... 205/96, 97, 211, 205/230, 231, 232, 233; 204/DIG. 7

[56] References Cited

U.S. PATENT DOCUMENTS

| | | | |
|---|---|---|---|
| 3,922,208 | 11/1975 | Cordone et al. | 205/97 |
| 4,534,832 | 8/1985 | Doiron, Jr. | 205/96 |
| 4,966,659 | 10/1990 | Seto et al. | 205/88 |
| 5,403,468 | 4/1995 | Nakakoji | 205/148 |

FOREIGN PATENT DOCUMENTS

| | | |
|---|---|---|
| 44-1809 | 1/1944 | Japan . |
| 63-12158 | 3/1988 | Japan . |
| 6-220689 | 8/1994 | Japan . |

*Primary Examiner*—Kathryn Gorgos
*Assistant Examiner*—William T. Leader
*Attorney, Agent, or Firm*—McDermott, Will & Emery

[57] ABSTRACT

A process for sulfurizing treatment of ferrous articles comprises positioning an electrolysis crucible containing a molten-salt bath of potassium thiocyanate and sodium thiocyanate and a pretreatment crucible containing a molten-salt bath of substantially the same composition adjacent to each other, assembling a unitary body by setting a plurality of the articles on a conductive support member in electrical contact therewith and attaching a cathode material to the support member to be out of contact with the articles and electrically insulated from the support member, immersing the unitary body in the bath contained in the pretreatment crucible, maintaining this bath temperature at substantially a prescribe bath temperature during ensuing electrolysis to bring the temperature of the unitary body near the prescribed temperature, transferring the unitary body from the pretreatment crucible to the bath in the electrolysis crucible while maintaining its temperature, and treating the articles by electrolysis. The process provides treated articles of consistently excellent surface quality.

5 Claims, 4 Drawing Sheets

PROCESS FOR SULFURIZING TREATMENT OF FERROUS ARTICLES

BACKGROUND OF THE INVENTION

1. Field of the Invention

This invention relates to a process for the surface treatment of articles having iron or iron alloy surfaces, more particularly to an improved process for sulfuring treatment of ferrous articles to improve their seizure-resistance property, wear-resistance property and the like by electrolyzing their ferrous surfaces to form FeS-system compounds thereon.

2. Description of the Related Art

When a ferrous article is electrolyzed as an anode in a molten salt bath of potassium thiocyanate and sodium thiocyanate, its ferrous surface is formed with a sulfurized layer (FeS-system compound layer) which markedly enhances the seizure-resistance property and wear-resistance property of the article. Sulfurizing technologies of this type are taught, for example, by JPB-44-1809, JPB-63-12158, and JPA-6-220689.

As set out in these publications, the molten salt used consists of, for example, potassium thiocyanate (rhodan potassium) and sodium thiocyanate (rhodan sodium) at a ratio of about 3:1 and the electrolysis is considered to be preferably effected at a temperature of about 190° C.±5 ° C. and a current density of around 1.5–4.0 $A/dm_2$.

This sulfuring treatment is characterized by its ability to improve the surface condition of various machine elements (components) subject to friction. The treatment is therefore most frequently applied to small components having precision machined dimensions such as small gears.

Since these machined components are used as rotating members or sliding members, the sections thereof lying perpendicular to the center axis are generally symmetrical. However, their surfaces include hills and valleys along the surface configuration. The worth of the component is determined by the dimensional precision of these irregular configurations and the uniformity of the surface quality. It is therefore essential that the component treated by sulfurizing incur no change in shape or dimensions relative to those prior to the treatment and that its surface be formed with a uniform sulfurized layer.

When such small articles are subjected to sulfuring treatment in an electrolysis crucible, however, an attempt to treat them all under exactly the same electrolysis conditions encounters various difficulties. For example, processing the individual articles as anodes makes it impossible to effect continuous treatment in the manner used to plate steel strip. Batch treatment therefore has to be adopted. In this case, each article has to be suspended in the bath as an anode. When an attempt is made to increase productivity by electrolyzing a few to ten articles simultaneously (in batch electrolysis), the position in the bath (the anode position, i.e., reaction position) differs between the different articles. As a result, the current density and, accordingly, the reaction rate differ from one article to another. Since this gives rise to differences in reaction behavior caused by uneven temperature distribution and composition distribution of the bath, it is difficult to stably form uniform sulfurized layers at the surfaces of all of the articles.

Further, when the articles are placed in the bath, matter adhering to the article surfaces mixes into and fouls the bath, while the sensible heat of the articles also produces changes in the bath. In addition, the treated articles hoisted out of the bath have bath components adhering thereto, so that the bath level (volume) is changed. Since these changes in the bath temperature, bath composition and bath volume express themselves as changes in the electrolysis conditions between one batch and another, they thwart the attempt to form uniform sulfurized layers in all batches.

SUMMARY OF THE INVENTION

Through their extensive experience in sulfurizing ferrous articles, the inventors learned that improvement of the seizure-resistance property, wear-resistance property, galling-resistance property and noise-suppression property of the treated articles requires attention to subtle effects produced by surface roughness and the surface roughness distribution of the formed sulfurized layer. When they attempted to achieve uniform surface roughness and roughness distribution of the sulfurized layers consistently in all articles, however, they encountered difficulties owing to the circumstances explained above. This invention was accomplished to overcome these difficulties.

This invention provides a process for sulfurizing treatment of ferrous articles by immersing articles having iron or iron alloy surfaces in a molten-salt bath of potassium thiocyanate and sodium thiocyanate contained in an electrolysis crucible and conducting electrolysis using the ferrous surfaces of the articles as anodes while maintaining a prescribed bath temperature, the process comprising a step of positioning adjacent to the electrolysis crucible a separate pretreatment crucible containing a molten-salt bath of substantially the same composition as said bath, a step of assembling a unitary body by setting a plurality of the articles on a conductive support member in electrical contact therewith and attaching a cathode material to the support member to be out of contact with the articles and electrically insulated from the support member, a step of immersing the unitary body in the bath contained in the pretreatment crucible, maintaining this bath temperature at substantially the prescribed bath temperature during electrolysis to bring the temperature of the unitary body near the prescribed temperature and transferring the unitary body from the pretreatment crucible to the bath in the electrolysis crucible while maintaining its temperature, and a step of applying a negative voltage to the cathode material and a positive voltage to the conductive support member of the unitary body in the bath contained in the electrolysis crucible, thereby treating the articles by electrolysis.

In one aspect of the process for sulfurizing treatment of ferrous articles according to the invention, the conductive support member forms a framework, the articles are identical in dimensions, shape and material, and the articles are supported on the framework of the conductive support member in a vertical row at intervals in electrical contact therewith.

In another aspect of the process for sulfurizing treatment of ferrous articles according to the invention, the articles are disk-shaped bodies having central through-holes (gears or the like) and the articles are supported on the conductive support member in a vertical row at intervals in electrical contact therewith with a rod-like cathode of smaller diameter than the diameter of the through-holes of the articles passing vertically through the through-holes.

In another aspect of the process for sulfurizing treatment of ferrous articles according to the invention, the articles are supported on the conductive support member in a vertical row with the intervals between pairs of adjacent articles increasing in the downward direction.

In another aspect of the process for sulfurizing treatment of ferrous articles according to the invention, the diameter of the rod-like cathode increases in the downward direction.

DESCRIPTION OF THE PREFERRED EMBODIMENTS

Figure 1:
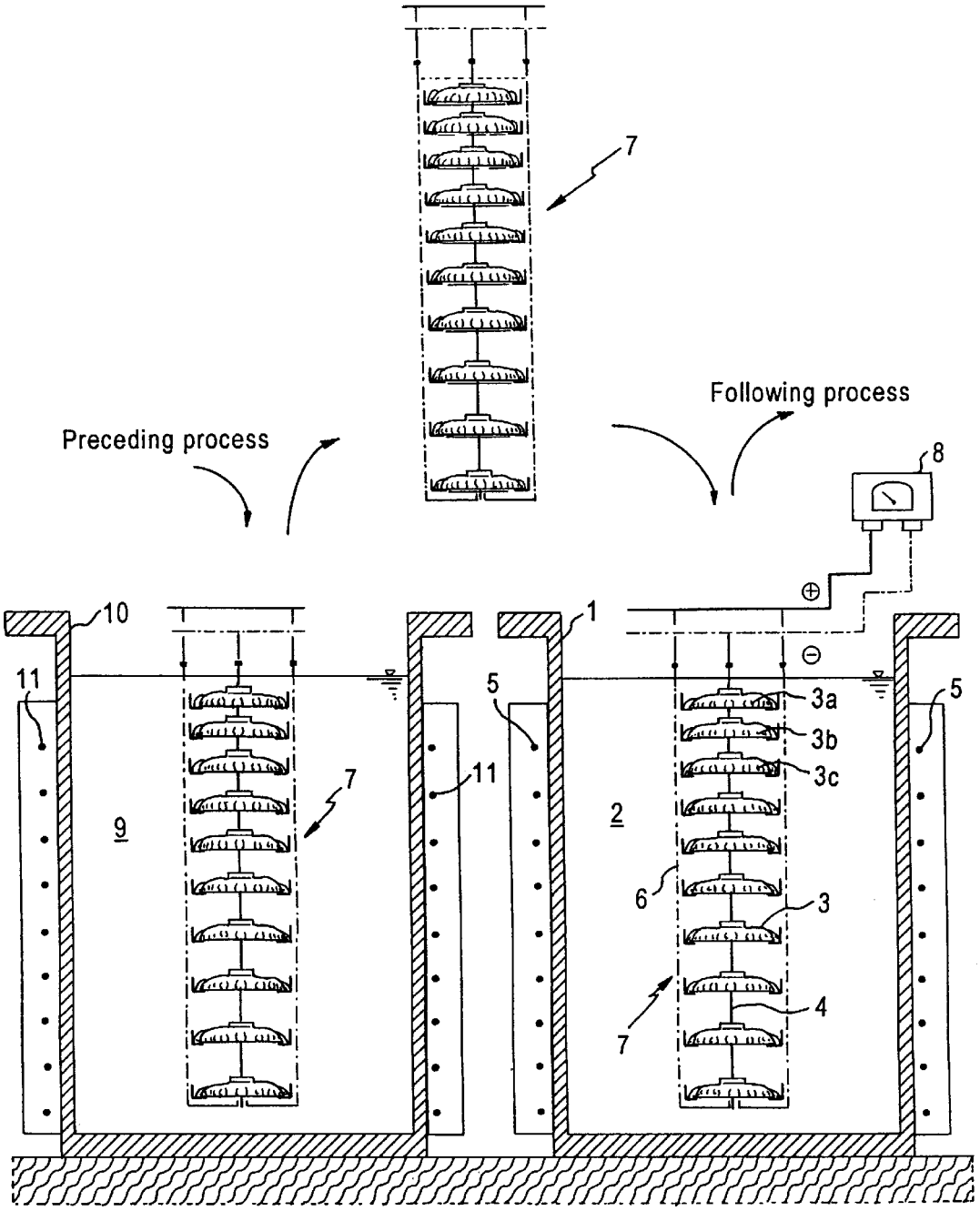
FIG. 1 is a mostly sectional view showing the layout of apparatuses constituting the main equipment for conducting the process of the invention.

FIG. 1 is a diagrammatic view showing one mode of implementing the process of this invention. In the invention process, articles 3 to be treated are immersed in a molten-salt bath 2 in an electrolysis crucible 1 and treated by electrolysis with the surfaces of the articles 3 as anodes. Reference numeral 4 designates the cathode. The articles 3 and the cathode 4 are united in a unitary body as will be explained further later. The electrolysis crucible 1 is enclosed by a heater 5. The bath can be adjusted to a prescribed temperature by controlling the amount of current passed through the heater 5. The bath 2 comprises a molten salt of potassium thiocyanate and sodium thiocyanate mixed at a ratio of about 3:1 and the current passed through the heater 5 is controlled so that the temperature detected by a thermometer (not shown) inserted into the bath is in the range of 190° C.±5° C.

The surfaces of the articles 3 to be treated are made of ferrous material, i.e., iron or iron alloy. The articles 3 are ordinarily machine components such as gears, cylinders, pistons or the like made of hardened steel, carburized steel, special steel or the like. FIG. 1 illustrates an example in which a large number of articles 3*a*, 3*b*, 3*c* . . . of the same dimensions, shape and material (e.g., identically shaped differential pion gears) are simultaneously sulfurized by batch electrolysis. For this, a unitary body 7 is assembled by setting the articles on a conductive support member 6 in electrical contact therewith and attaching the cathode 4 to the support member 6 to be out of contact with the articles and electrically insulated from the support member. The unitary body 7 is shown immersed in the bath 2.

The entire unitary body 7 is immersed in the molten-salt bath 2 adjusted to a temperature in the neighborhood of 190° C. in the foregoing manner. Electrolysis is started by using a current source 8 to apply voltage across the cathode 4 and the conductive support member 6, with negative being applied to the former and positive voltage to the latter. This starts an anodic reaction at the ferrous surface of the articles 3 which forms FeS on the ferrous surfaces, presumably by the reaction sequence:

$$Fe \longrightarrow Fe^{2+} + 2e^{-1}$$

$$SCN^{-1} + 2e^{-1} \longrightarrow S^{2-} + CN^{-1}$$

$$Fe^{2+} \longrightarrow FeS.$$

Looked at in another way, this means that S sulfurizes the iron and the article surfaces. The amount of FeS formed may, therefore, not be the stoichiometric amount. The thickness of the sulfurized layer formed varies with the electrolysis conditions and the type of steel, but is about 10 $\mu$m under conditions of an electrolysis temperature of 190° C.±5° C., current density of 1.5–4.0 A/dm$^2$ and electrolysis duration of 10 minutes. However, the surface roughness varies subtly with the treatment conditions. If the surface roughness is optimum, the article, when its surface is subject to friction during use, enjoys enhanced lubricating action, and exhibits outstanding the seizure-resistance property, wear-resistance property, galling-resistance property and noise-suppression property.

Through their experience, the inventors learned that when the unitary body 7 is immediately immersed in the molten-salt bath 2 and treated by electrolysis, subtle differences in quality arise from one batch to another and from one article to another within the same batch. These differences occur no matter how much effort is made to maintain the electrolysis conditions constant.

The inventors discovered that one way of overcoming this problem is to provide a pretreatment crucible. Specifically, as shown in FIG. 1, a pretreatment crucible 10 containing a molten-salt bath 9 of the same composition as the bath 2 of the electrolysis crucible 1 is provided adjacent to and independently of the electrolysis crucible 1. Unlike the electrolysis crucible 1, the pretreatment crucible 10 is not equipped with a cathode. Similarly to the electrolysis crucible 11 the pretreatment crucible 10 is equipped with a heater 11 enclosing the wall thereof and the current passed through the heater 11 is automatically controlled so that the temperature detected by a thermometer (not shown) inserted into the bath 9 maintains a predetermined value 190±5° C).

The entire unitary body 7 is immersed in the molten-salt bath 9 in the pretreatment crucible 10 and the bath temperature is maintained at 190° C.±5° C. for a prescribed time period to bring the unitary body 7 near the bath temperature. When the unitary body 7 has substantially reached the bath temperature, it is raised out of the bath 9 and immediately immersed "as is" in the bath 2 of the electrolysis crucible 1. Since the unitary body 7 is at substantially the same temperature as the bath 2, its immersion causes no appreciable change in the temperature of the bath 2. Further, when the unitary body 7 is transferred from the pretreatment crucible 10 to the electrolysis crucible 1, it carries with it into the electrolysis crucible 1 adhering bath matter of an amount and composition substantially the same as the amount and composition of the adhering bath matter it carries out of the bath 2 when it is raised out of the electrolysis crucible 1 on completion of the treatment. It is therefore possible to avoid both temperature change by immersion of the unitary body 7 in the electrolysis crucible 1 and change in the amount of bath matter in the electrolysis crucible 1 when the unitary body 7 is hoisted out of the electrolysis crucible 1. In addition, impurities and the like adhering to the unitary body at the start are to some degree removed beforehand by the immersion in the pretreatment crucible 10. Since causes working to alter the electrolysis between one batch and another are diminished, products of consistent quality can be obtained.

As the sulfurized layer is extremely thin, the sulfurizing consumes only a very small amount of S from the bath. The change in the bath composition with continuing electrolysis is therefore slight. This means that the difference arising between the bath compositions of the pretreatment crucible 10 and the electrolysis crucible 1 with continuing treatment is slight. This precludes any disadvantage from the installation of the pretreatment crucible 10 alongside the electrolysis crucible 1 and accents the advantages of the arrangement. It is required, however, that when the unitary body is immersed in the bath 2 of the electrolysis crucible 1 by immersing it first in the bath 9 of the pretreatment crucible 10 and then transferring it to the electrolysis crucible 1, no change be made in shape or number of articles. Unitary bodies having different types and numbers of articles can be similarly processed in different batches so long as this condition is observed for each batch.

Figure 2:
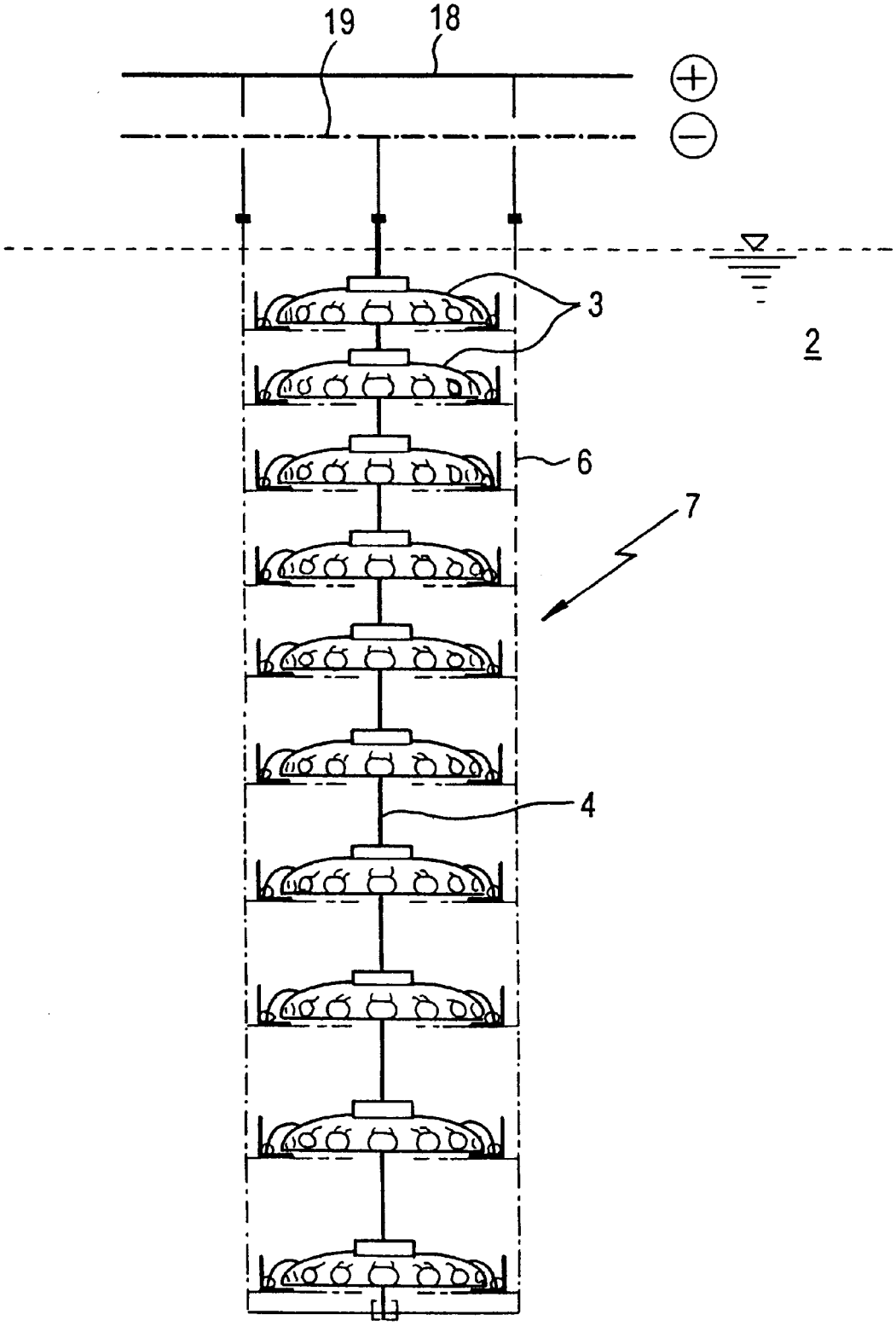
FIG. 2 is a front view showing an arrangement of articles treated in a bath.
Figure 3:
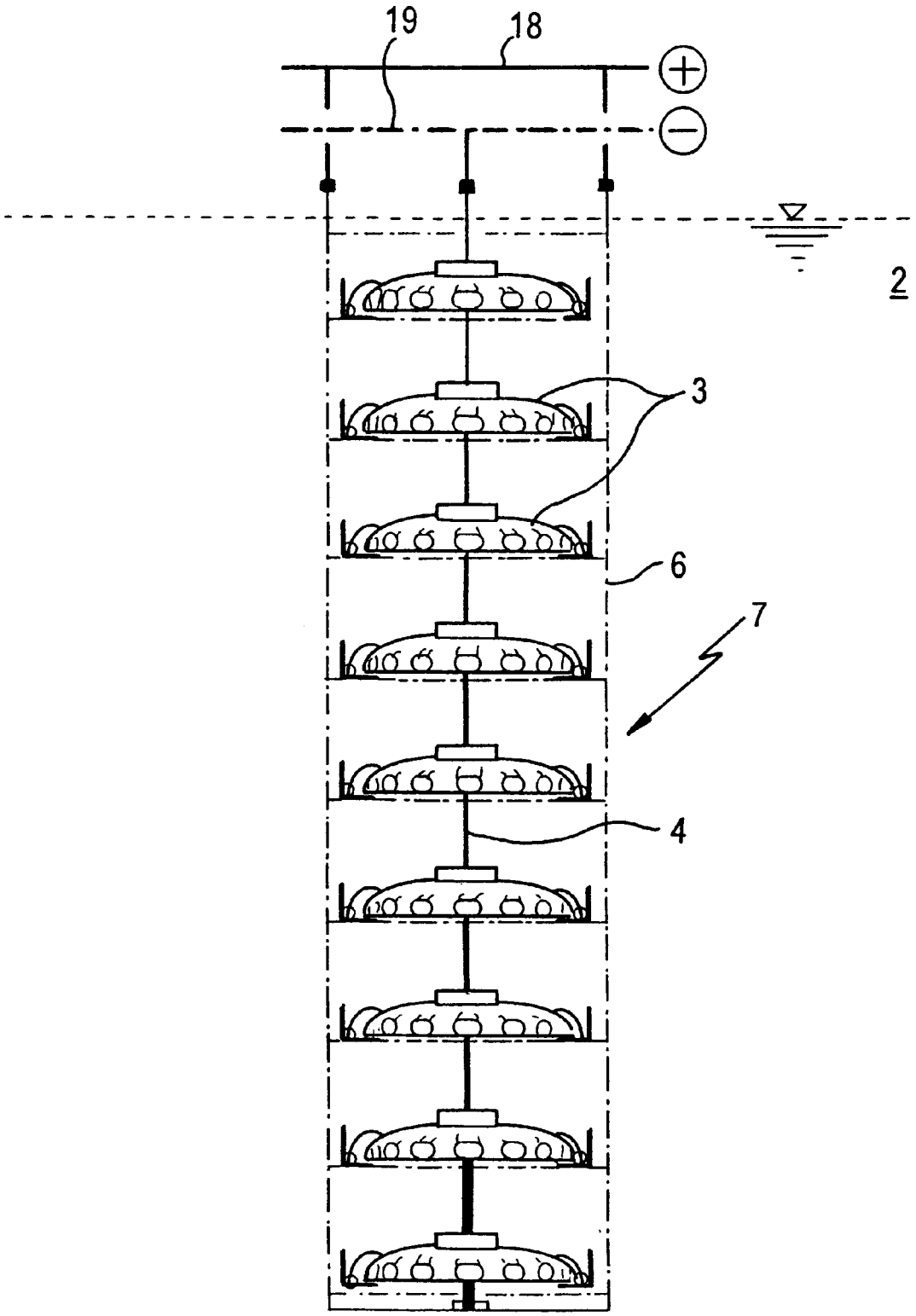
FIG. 3 is a front view showing another arrangement of articles treated in a bath.

The inventors further discovered that the aforesaid problem can be overcome by appropriately distributing the current to the articles 3 placed in the electrolysis bath 2. Specifically, this involves appropriately selecting the shape of the articles 3 and the positions at which the plurality of articles 3 supported by the conductive support member 6 for immersion in the bath are attached. FIGS. 2 and 3 arrangements according to the invention for this purpose.

FIG. 2 shows a case in which a unitary body 7 is assembled by integrally setting a plurality of articles 3 to be treated having the same dimensions, shape and material on a conductive support member 6 and attaching a cathode 4 to the support member 6 to be out of contact with the articles 3 and electrically insulated from the support member 6. The unitary body 7 is shown immersed in the bath 2. The articles 3 are set so that the spacing between adjacent ones thereof increases with increasing depth of immersion in the bath.

FIG. 3 shows a case in which a unitary body 7 is assembled by integrally setting a plurality of articles 3 having the same dimensions, shape and material on a conductive support member 6 and attaching a cathode 4 to the support member 6 to be out of contact with the articles 3 and electrically insulated from the support member 6. The unitary body 7 is shown immersed in the bath 2. The cathode 4 is rod-like and increases in thickness with increasing depth of immersion in the bath.

FIGS. 2 and 3 show differential pinion gears as examples of the articles 3 to be treated. Although gear design generally calls for different shape, dimension and material depending on the intended application, all gears are the same in the point of being disk-shaped bodies with a center through-hole. In the examples of FIGS. 2 and 3, a rod-like cathode 4 is inserted through the through-holes of the articles (gears) 3 so as not to make contact with the walls of the through-holes. The unitary body 7 is assembled as follows.

The conductive support member 6 forms framework. The framework comprises a series of unit cells arranged in the vertical direction and each cell accommodates a single article 3.

Figure 4:
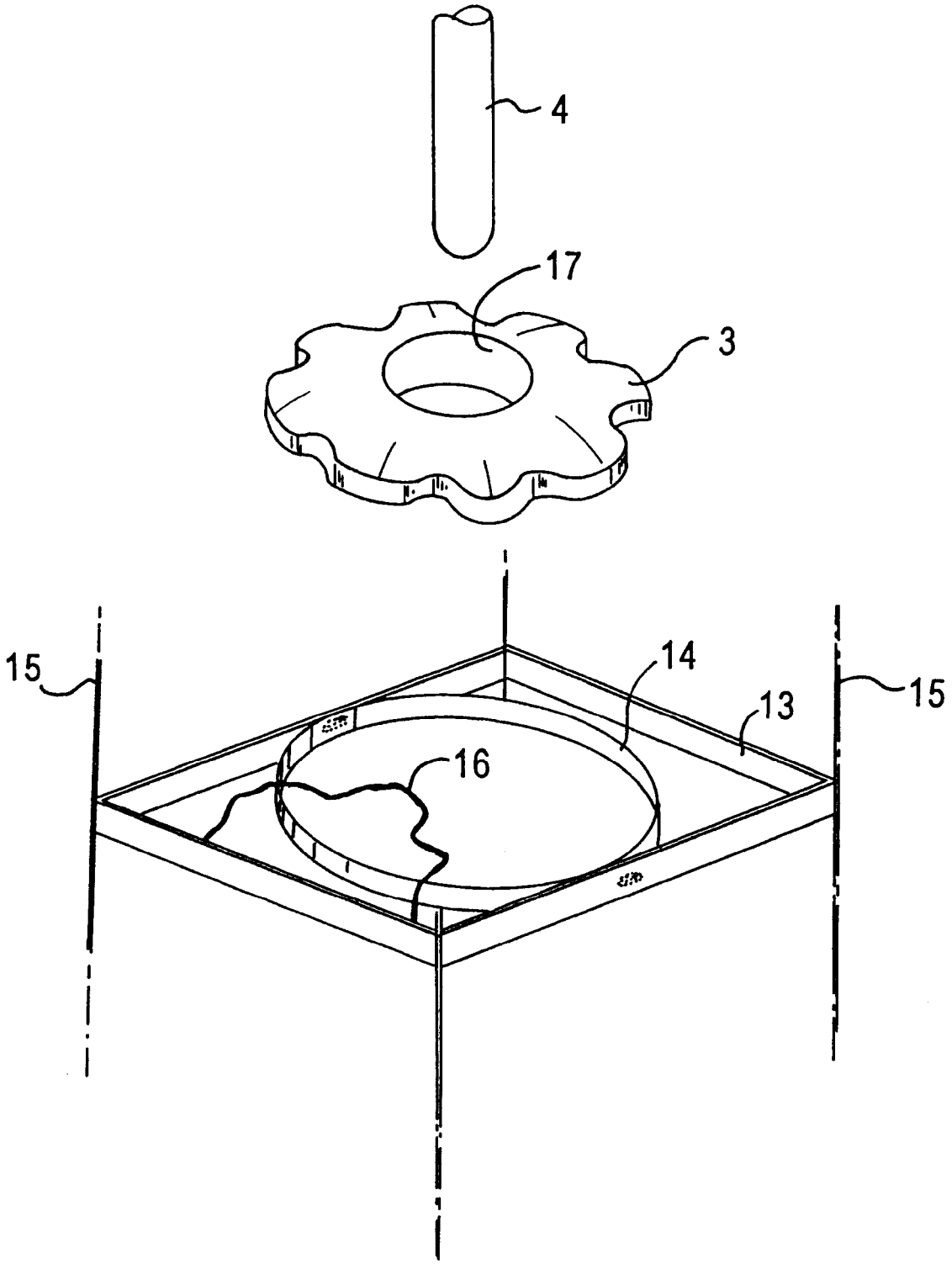
FIG. 4 is an exploded view showing part of a unitary body to be immersed in a bath.

As shown in the partial view of FIG. 4, each unit cell has a stage 14 for supporting an article 3 formed within a square frame 13. The frames 13 are supported by a vertically extending skeleton 15 to constitute the series of unit cells in the vertical direction. The frames 13, stages 14 and skeleton 15 are welded together to be in electrical continuity with each other. The stages 14 are of cylindrical shape. The articles (gears) 3 are placed on the stages 14 and are fixed in place on the stages 14 by retainers 16 made of spring material. The rod-like cathode 4 is inserted through the through-holes 17 of the articles (gears) 3 without contacting the walls of the through-holes 17.

Each of the conductive support members 6 of the unitary bodies 7 shown in FIGS. 2 and 3 therefore comprises a framework formed with a vertical series of unit cells for placing a plurality of articles in a vertical row. Each unit cell comprises a stage 14 and an article retainer 16. Since the whole is in electrical continuity, the articles 3 can be put in electrical connection with the positive pole by connecting the framework to a positive pole bus bar 18. Since the cathode 4 is out of contact with the articles 3 and is insulated from the conductive support member 6 (is fixed in place by connection to the upper and lower extremities of the framework through insulating material, e.g., an insulating resin material such as Teflon (Reg. ™)), electrolysis can be conducted with the surfaces of the articles 3 as anodes by connecting the cathode 4 to a negative pole bus bar 19.

The unitary body 7 assembled in the foregoing manner is suspended from the positive pole bus bar 18 and the negative pole bus bar 19, which are made to an appropriate size for this purpose. By using the bus bars as conveyance hangers for the unitary body 7, such operations as lowering the unitary body 7 into and hoisting it out of the pretreatment crucible 10 and the electrolysis crucible 1 can be conducted safely.

Although the unitary bodies of FIGS. 2 and 3 are configured to carry the articles 3 in a single vertical row, they can instead be configured to carry them in multiple rows arranged in parallel. Specifically, the unit cells for placement of the articles can be configured in the manner of a jungle gym to extend three-dimensionally in the vertical, lateral and depth directions. In this case, too, each of the vertical rows is preferably provided with a rod-like cathode 4. Further, it is preferable to adopt an arrangement enabling the articles 3 to be set so that the spacing between adjacent ones thereof increases with increasing depth of immersion in the bath, as shown in FIG. 2, or an arrangement in which the diameter of the cathode 4 increases with increasing depth of immersion in the bath, as shown in FIG. 3.

Although the structure of FIG. 2 in which the article spacing enlarges downward and the structure of FIG. 3 in which the diameter of the cathode 4 increases downward can be separately adopted, the two structures can also be combined. The two structures have the common characteristic of enabling the articles at greater immersion depth to face a larger surface area of the electrode. It was confirmed that the adoption of these structures enabled the formation of uniform sulfurized layers and articles of the same quality irrespective of immersion depth. The cause of this effect is presumed to be that the structures enable uniform distribution of electric current to the articles regardless of differences in their immersion locations.

The optimum range of the amount of increase in the article spacing or the electrode surface area with immersion depth is a function of the article size and the electrolysis conditions. An expert in the field can easily determine the optimum amount of increase under given electrolysis conditions by conducting two or three trial runs under these conditions.

If the articles are of a type that lack a center hole, the electrode cannot be passed through their centers. In such a case it suffices to configure the unitary body in accordance with the shape of the articles so that the electrode is present at the most appropriate location in the vicinity of each article. Here, again, it is important to ensure that the articles at greater immersion depth face a larger surface area of the electrode.

EXAMPLES

Example 1

Ten-toothed vehicle differential pinion gears made of JIS SCM 415 case-hardened steel and measuring 53 mm in outer diameter, 18 mm in inner diameter and 18 mm in maximum thickness were subjected to sulfurizing treatment by the process of the invention. Prior to sulfurizing, the gears were carburized at 930° C. for 6 hours, quenched in oil from 840°

C. in the temperature increase phase of the carburization, and tempered at 180° C. Their surfaces were cleaned by degreasing, pickling, washing, neutralizing and washing. The unitary body 7 was assembled in the manner explained with reference to FIGS. 2 and 3 to arrange 20 identical gears in a single vertical row. The rod-like cathode 4 had a constant diameter in the lengthwise direction (bath depth direction) and the gears were regularly spaced at intervals of 40 mm in the bath depth direction.

The framework, stages and spring retainers of the unitary body 7 were made of SUS 304 stainless steel and the electrode was a 4 mm-diameter rod of SUS 304 stainless steel. The electrolysis crucible 1 and the pretreatment crucible 10 (both of SUS 304 stainless steel) were both 2200 mm×1400 mm in cross-section and 1350 mm in depth. The crucibles were placed side by side and charged with baths 2 and 9 consisting of 75% potassium thiocyanate and 25% sodium thiocyanate to a bath level of about 1150 mm. With the bath temperature controlled to 190° C., the unitary body 7 was first immersed in the bath 9 in the pretreatment crucible 10. The temperature of the unitary body 7 was confirmed to be 190° C. after ten-minutes immersion. After 20 minutes of immersion, the unitary body 7 was removed from the pretreatment crucible and immediately immersed without modification in the bath 2 in the adjacent electrolysis crucible 1. The cathode 4 and the conductive support member 6 of the unitary body 7 were respectively connected to the positive pole terminal and the negative pole terminal of the current source. Treatment by electrolysis was effected for 10 minutes at a bath temperature of 190° C., an electrolysis voltage of 8 V, and a current density of 3.2 A/dm$^2$. The unitary body was then removed intact from the electrolysis crucible and washed intact in a washing tank. Sixty cycles of this treatment were conducted per day.

For comparison, treatment by electrolysis was conducted in the same manner except that the unitary body 7 was immersed in the bath 2 in the electrolysis crucible 1 without first being pretreated by immersion in the pretreatment crucible. In this case, the immersion of the unitary body 7 in the bath 2 in the electrolysis crucible 1 lowered the bath temperature by about 8° C. and about 10 minutes were required for the temperature of the unitary body 7 to rise to 190° C.

The treatment time required per batch was 10 minutes in Example 1 and 20 minutes in the comparative example, while the fall in the bath level in the electrolysis crucible 1 after 60 treatment cycles was only around 10 mm in Example 1 but was 75 mm in the comparative example. Gears treated in the first and final batches were tested for seizure resistance. The gears of Example 1 showed no difference whatsoever in performance, while those of the comparative example were somewhat different in performance.

Example 2

The same type of components (differential pinion gears) as in Example 1 were treated using the same unitary body 7 as in Example 1, except that the spacing between adjacent gears was increased with increasing immersion depth in the manner of FIG. 2. Specifically, the spacing of gears 1–10 of the top group was set at 35 mm, that of the 11–15 group was increased to 40 mm and that of the 16–20 group was increased to 50 mm.

Aside for the use of the unitary body with downwardly enlarged spacing, treatment was effected in the same manner as in Example 1, i.e., by immersion first in the pretreatment crucible and then in the electrolysis crucible, followed by electrolysis under the same conditions as in Example 1.

The surface roughnesses of the treated gears of the top and bottom groups obtained in this Example were measured. Those of the top group had Rmax of 12.0 μm and those of the bottom group Rmax of 9 μm, a mere difference of 3 μm. In contrast, Rmax of the gears of the top group in Example 1 was 18 μm and that of the bottom group was 5 μm.

Example 3.

The same type of components (differential pinion gears) as in Example 1 were treated using the same unitary body 7 as in Example 1, except that the diameter of the cathode 4 was increased with increasing immersion depth in the manner of FIG. 3. Specifically, the gears were placed on stages regularly spaced at intervals of 40 mm but the diameter of the cathode rod 4 was set at 4 mm between the first and tenth stages and at 6 mm between the tenth and twentieth stages. Treatment was effected in the same manner as in Example 1, i.e., by immersion first in the pretreatment crucible and then in the electrolysis crucible, followed by electrolysis under the same conditions as in Example 1.

The surface roughnesses of the treated gears of the top and bottom groups obtained in this Example were measured. Those of the top group had Rmax of 12.0 μm and those of the bottom group Rmax of 9 μm, a mere difference of 3 μm.

Thus, as explained in the foregoing, this invention produces an outstanding effect of eliminating occurrence of variance in surface quality (state of the sulfurized layer) among ferrous articles sulfurized using a molten-salt bath of potassium thiocyanate and sodium thiocyanate, even when the treatment is effected batchwise.

What is claimed is:

1. A process for sulfurizing treatment of ferrous articles by immersing articles having iron or iron alloy surfaces in a molten-salt bath of potassium thiocyanate and sodium thiocyanate contained in an electrolysis crucible and conducting electrolysis using the ferrous surfaces of the articles as anodes while maintaining a prescribed bath temperature, the process comprising:

a step of positioning adjacent to the electrolysis crucible a separate pretreatment crucible containing a molten-salt bath of substantially the same composition as said bath, a step of assembling a unitary body by setting a plurality of the articles on a conductive support member in electrical contact therewith and attaching a cathode material to the support member to be out of contact with the articles and electrically insulated from the support member, a step of immersing the unitary body in the bath contained in the pretreatment crucible, maintaining this bath temperature at substantially the prescribed bath temperature during electrolysis to bring the temperature of the unitary body substantially to the prescribed temperature and transferring the unitary body from the pretreatment crucible to the bath in the electrolysis crucible while maintaining its temperature, and a step of applying a negative voltage to the cathode material and a positive voltage to the conductive support member of the unitary body in the bath contained in the electrolysis crucible, thereby treating the articles by electrolysis.

2. A process according to claim 1, wherein the conductive support member forms a framework, the articles are identical in dimensions, shape and material, and the articles are supported on the framework of the conductive support member in a vertical row at intervals in electrical contact therewith.

3. A process according to claim 2, wherein the articles are disk-shaped bodies having central through-holes and the articles are supported on the conductive support member in a vertical row at intervals in electrical contact therewith, with a rod-shaped cathode of smaller diameter than the diameter of the through-holes of the articles passing vertically through the through-holes.

4. A process according to claim 3, wherein the diameter of the rod-shaped cathode increases in the downward direction.

5. A process according claim 1, wherein the articles are supported on the conductive support member in a vertical row with the intervals between pairs of adjacent articles increasing in the downward direction.

* * * * *